US011484770B2

(12) United States Patent
Selvik et al.

(10) Patent No.: US 11,484,770 B2
(45) Date of Patent: Nov. 1, 2022

(54) CONSTRUCTION OF SKATES

(71) Applicants: Stian Selvik, Rasta (NO); Joachim Selvik, Jessheim (NO)

(72) Inventors: Stian Selvik, Rasta (NO); Joachim Selvik, Jessheim (NO)

( * ) Notice: Subject to any disclaimer, the term of this patent is extended or adjusted under 35 U.S.C. 154(b) by 0 days.

(21) Appl. No.: 16/615,246

(22) PCT Filed: May 22, 2018

(86) PCT No.: PCT/NO2018/050131
§ 371 (c)(1),
(2) Date: Nov. 20, 2019

(87) PCT Pub. No.: WO2018/217094
PCT Pub. Date: Nov. 29, 2018

(65) Prior Publication Data

US 2020/0164263 A1 May 28, 2020

(30) Foreign Application Priority Data

May 22, 2017 (NO) ..... 20170835

(51) Int. Cl.
*A63C 1/22* (2006.01)

(52) U.S. Cl.
CPC ..... *A63C 1/22* (2013.01)

(58) Field of Classification Search
CPC ..... A63C 1/22
See application file for complete search history.

(56) References Cited

U.S. PATENT DOCUMENTS 1,111,246 A * 9/1914 Button ..... A63C 1/24 280/11.14
2,829,821 A * 4/1958 Faigle ..... G06C 7/06 235/60 R (Continued)

FOREIGN PATENT DOCUMENTS

CA 2212229 A1 * 8/1996 ..... A43B 5/1691
CA 2290209 A1 * 6/2000 ..... A43B 5/1608

(Continued)

OTHER PUBLICATIONS

International Search Report Issued by the European Patent Office acting as the International Searching Authority in relation to International Patent Application No. PCT/NO2018/050131dated Jun. 27, 2019 (4 pages).

(Continued)

*Primary Examiner* — James A Shriver, II
*Assistant Examiner* — Michael T. Walsh
(74) *Attorney, Agent, or Firm* — Carter, DeLuca & Farrell LLP; Robert P. Michal

(57) ABSTRACT

A skate including a shoe/boot part and a skate iron/blade part, wherein the skate iron/blade part includes a skate iron/blade and a rear and forward intermediate mounting element connecting the skate iron/blade to the shoe/boot part, wherein at least a part of the forward mounting element may be compressed in the vertical direction, said forward mounting element being equipped with a resilient device that may be compressed through vertically loading the skate and that mainly returns to its original form when the vertical load of the skate diminishes.

20 Claims, 4 Drawing Sheets

(56) References Cited

U.S. PATENT DOCUMENTS

| | | | | | |
|---|---|---|---|---|---|
| 3,705,505 | A * | 12/1972 | Landow | E05B 65/0021 | 292/216 |
| 4,003,614 | A * | 1/1977 | Geer | E05B 65/46 | 312/332.1 |
| 4,670,949 | A | 6/1987 | Autry | | |
| 5,109,581 | A * | 5/1992 | Gould | A43C 5/00 | 24/713.9 |
| 5,582,418 | A * | 12/1996 | Glosser | A63C 17/0046 | 280/11.225 |
| 5,823,543 | A * | 10/1998 | Burns | A63C 17/062 | 280/11.225 |
| 8,113,340 | B1 * | 2/2012 | Smith | B65G 17/40 | 198/853 |
| 2001/0045726 | A1 * | 11/2001 | Pedersen | A63C 9/006 | 280/611 |
| 2002/0084601 | A1 * | 7/2002 | Wu | A63C 17/26 | 280/11.115 |
| 2008/0012248 | A1 * | 1/2008 | von Detten | A63C 17/0046 | 280/11.12 |
| 2013/0020773 | A1 * | 1/2013 | Green | A63C 17/262 | 280/11.214 |
| 2013/0175771 | A1 * | 7/2013 | Shepley | A63C 1/16 | 280/11.3 |
| 2014/0291946 | A1 * | 10/2014 | Brown | A63C 1/24 | 280/11.14 |
| 2014/0355191 | A1 * | 12/2014 | Lin | G06F 1/1679 | 361/679.17 |
| 2016/0001162 | A1 * | 1/2016 | Azzolin | A63C 1/28 | 280/11.18 |
| 2017/0332736 | A1 * | 11/2017 | Casas | A43C 11/1493 | |
| 2022/0118345 | A1 * | 4/2022 | Zhang | A63C 17/12 | |

FOREIGN PATENT DOCUMENTS

| | | | | | |
|---|---|---|---|---|---|
| CA | 2292999 | A1 * | 6/2000 | A63C 1/22 | |
| DE | 202005017345 | U1 * | 1/2006 | A63C 17/0046 | |
| DE | 202005017345 | U1 * | 2/2006 | A63C 17/0046 | |
| JP | H09225085 | A * | 2/1997 | | |
| JP | H09225085 | A * | 9/1997 | | |
| KR | 20200023771 | A * | 3/2020 | | |
| KR | 20200023771 | A * | 6/2020 | | |
| NL | 2026028 | B1 * | 3/2022 | | |
| WO | WO-9725114 | A1 * | 7/1997 | A63C 17/0046 | |
| WO | WO-0015312 | A1 * | 3/2000 | A63C 1/00 | |
| WO | WO-2007/061229 | A1 | 5/2007 | | |
| WO | WO-2007061229 | A1 * | 5/2007 | A63C 1/30 | |
| WO | WO-2014138977 | A1 * | 9/2014 | A63C 1/28 | |
| WO | WO-2018217094 | A2 * | 11/2018 | A63C 1/30 | |

OTHER PUBLICATIONS

Written Opinion of the International Searching Authority issued by the European Patent Office acting as the International Searching Authority in relation to International Patent Application No. PCT/NO2018/050131 dated Jun. 27, 2019 (9 pages).

Norwegian Search Report issued by the Norwegian Patent Office in relation to Norwegian Application No. 20170835 dated Nov. 24, 2017 (2 pages).

* cited by examiner

CONSTRUCTION OF SKATES

CROSS-REFERENCE TO RELATED APPLICATIONS

This application is a National Phase Entry of PCT Patent Application No. PCT/NO2018/050131 filed May 22, 2018, which claims the benefit under 35 USC § 119(e) to Norwegian Patent Application No. 20170835, filed May 22, 2017, the disclosure of each of these applications are expressly incorporated herein by reference in their entireties.

The present invention concerns a device for skates, said device being located between the shoe section and the skate iron, in the intermediate section, in the section between the skate iron and the toe section of the skate being equipped with a resilient device bouncing in the vertical direction, and wherein the device in the section between the skate iron and the heel section of the shoe part of the skate comprises a hinge or a sliding device allowing said movement of the shoe/boot part of the skate in the vertical direction.

BACKGROUND FOR THE INVENTION

Within skating sports it is continuously desired to increase the speed and the flexibility of the athlete for improving the athlete's opportunities to compete. Within the branch of distance skating it is desired to increase the speed, whereas within e.g. ice hockey, bandy or figure skating it is desired to increase both the speed and the manoeuvrability of the athlete. Particularly within team sports such as ice hockey or bandy increased speed and manoeuvrability will represent advantages in relation to participants that do not have devices on their skates providing such properties. Within figure skating it would be an advantage to be able to quickly accelerate as well, since some of the movements of the figure skating exercises demand both rapid acceleration, large speed and rapid deceleration. Devices providing such properties must, however, not make the skate less dependable or harder to manoeuvre for the athlete/participant.

PRIOR ART

For many years it has been known that equipping skates for distance skating with a skate iron being hinged at the toe end will improve the back-kick of the participant by the skate iron being in contact with the ice over the entire skate iron for thereby increasing the speed of the athlete, so-called "clap-skates". However, such a device is not suitable in skates for skating sports where it is necessary with an improved manoeuvrability and acceleration such as e.g. ice hockey, bandy and figure skating, since a skate iron being loose in the heel section of the skate would compromise the control of the skate in manoeuvres such as deceleration, stepping and turning.

From US patent 2016/0001162 A1 it is known a device for supplying a dynamic movement to a skate, wherein the device comprises a skating iron system with a shoe/boot part, a skating iron housing mounted to the underside of the shoe/boot part and a skating iron section having a heel and toe end, wherein the skating iron part is fastened at the heel end to the housing in an immovable manner and is secured undetachably from the skating iron part of the skating iron housing at the toe end.

It is also previously known to equip the skating iron section of an ice hockey skate or the wheel of an in-line skate with resilient elements, but such resilient elements serve the purpose of working as equalizing elements for removing the vibration in the shoe/boot section and do not provide any energy-storing function.

It is also of importance to consider where in the skate the energy-storing and dynamic devices are located. The reason for this is that the skating iron section of a skate is the part being subjected to the largest load and wear and, if the skate is to function optimally, it is continuously necessary to sharpen the skate iron/blade. This makes the skate blade smaller and smaller, and consequently it will become necessary to change the skating skates if the skating iron/blade is not exchangeable. Such a changing of the skate may, however, be undesired since a molding by wear of the shoe/boot part to the athlete's feet may have an effect that it is not desired to change this part of the skate.

A resilient device making it possible for a skate iron/blade socket to touch the ice through a springing action of the skate iron/blade into a holder or holster is also undesired since such a construction may disrupt the performer's control of the manoeuvring at a large load of the skate during execution of the relevant manoeuvre.

It is consequently desired a skate wherein these disadvantages are avoided while simultaneously providing the skate with an energy-storing device for assisting abrupt, demanding and strongly accelerating movements.

DESCRIPTION OF THE INVENTION

The present invention will become better understood with reference to the enclosed figures showing embodiments of the skating device according to the invention.

Figure 4B:
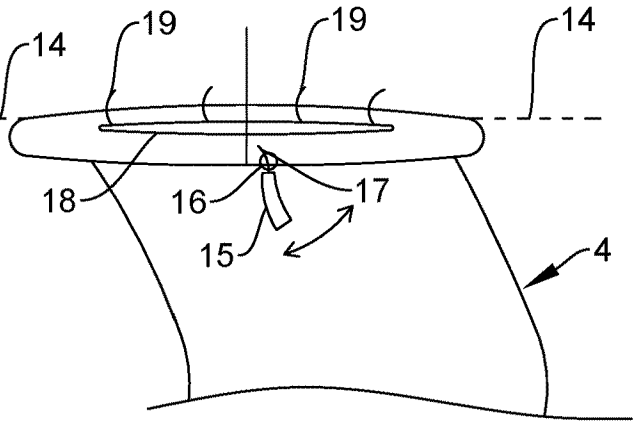
Figure 4A:
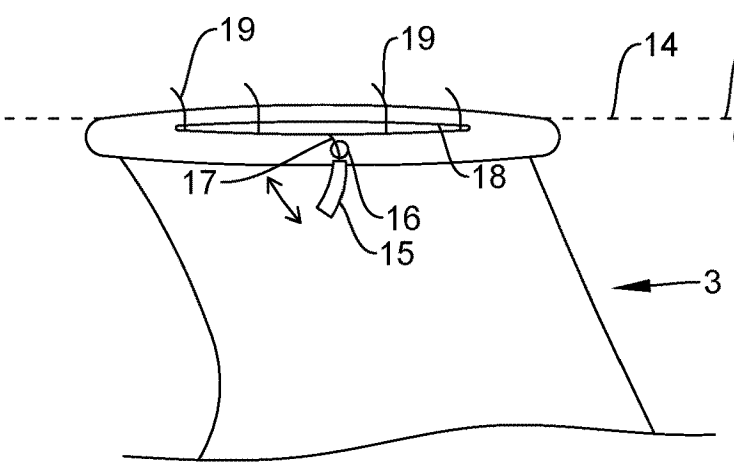

FIGS. 4*a* and 4*b* show an embodiment of a securing system that may secure a mounting section for a skate blade to a shoe/boot part of a skate.

Figure 5:
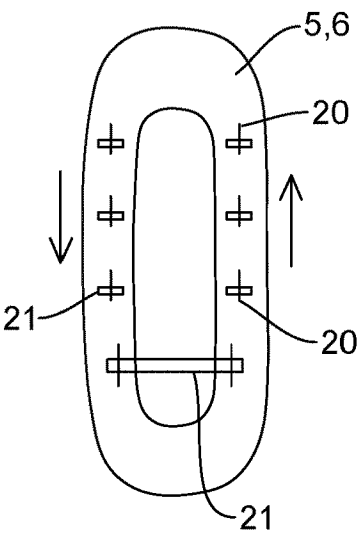

FIG. 5 shows the securing system of FIGS. 4*a* and 4*b* seen from above.

Figure 6:
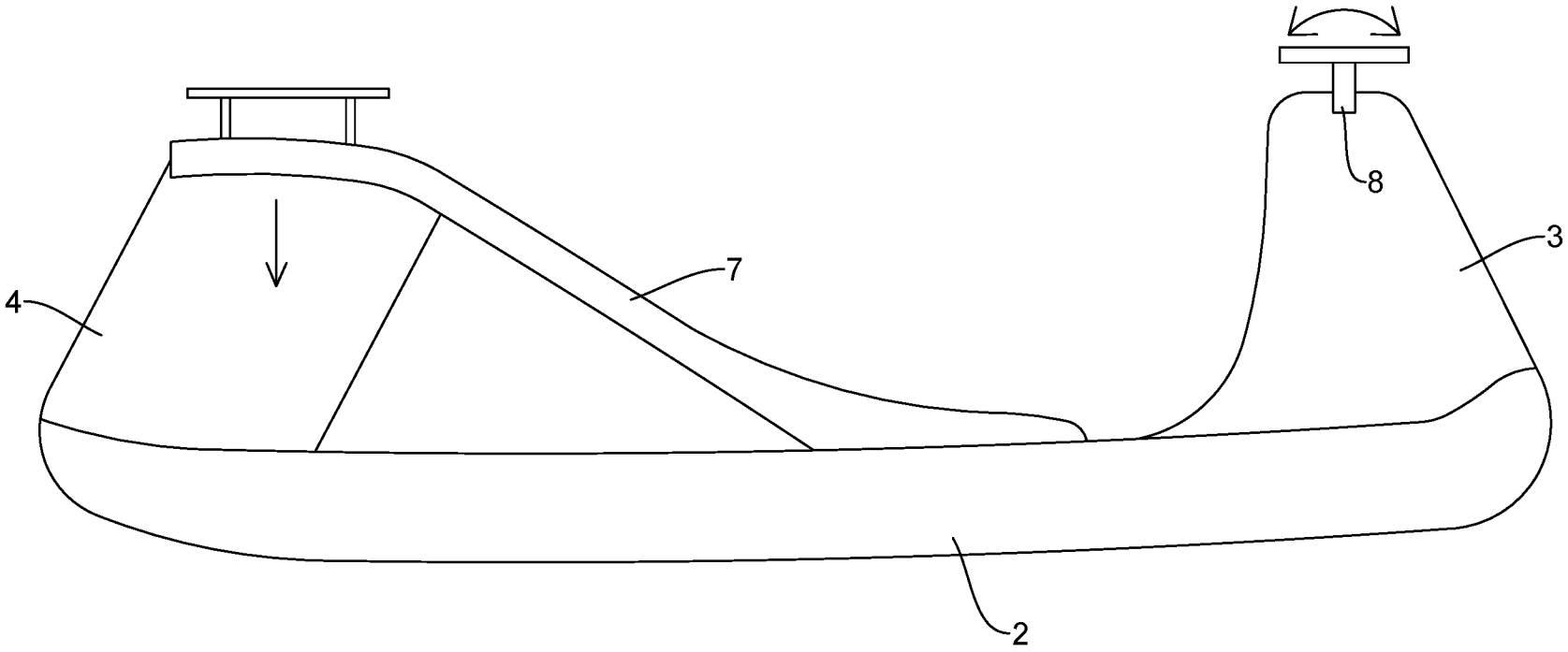

FIG. 6 shows an embodiment of the spring system according to the invention mounted to a skate iron/blade.

Figure 1:
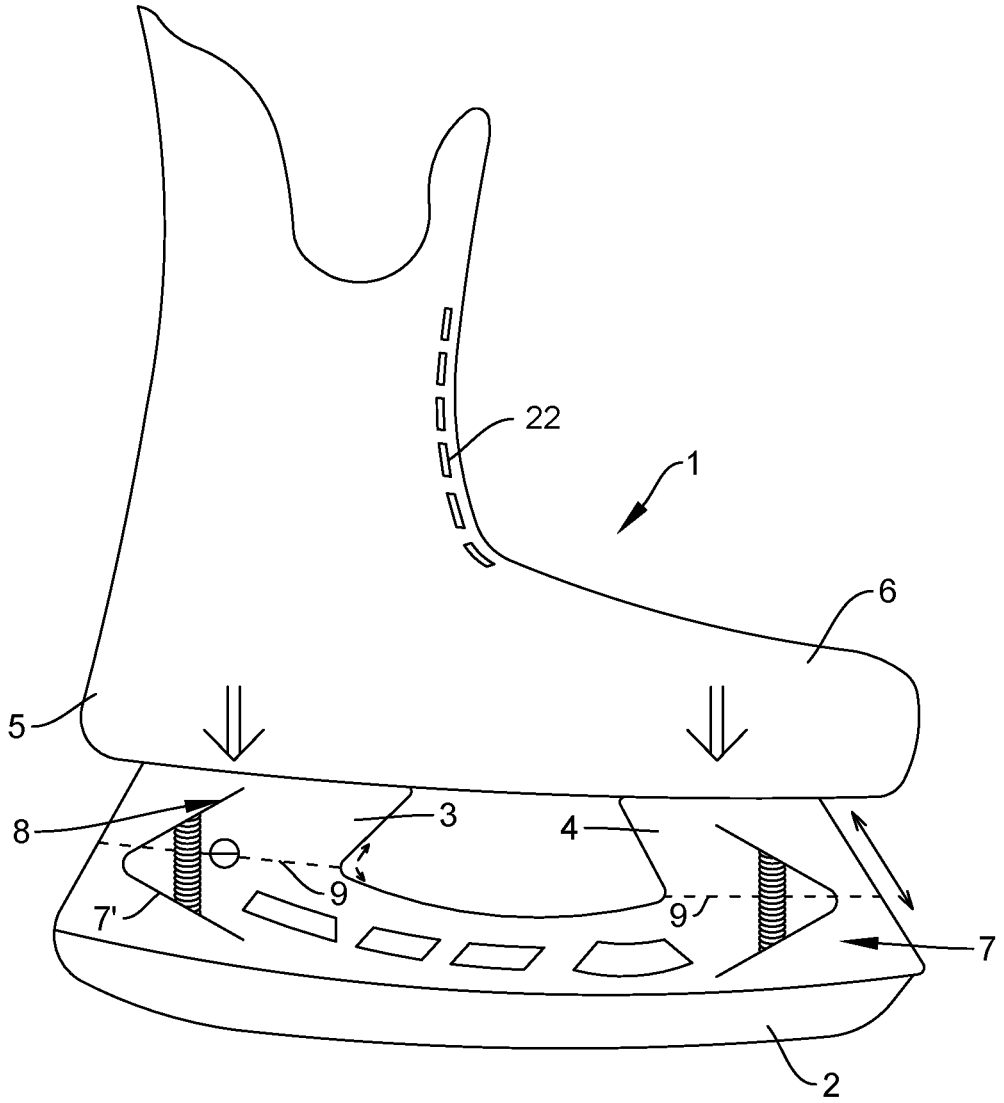
FIG. 1 shows a schematic representation of a skate assembly according to the invention.

FIG. 1 shows a schematic representation of an embodiment of a skate with a shoe/boot section 1 wherein the shoe/boot section 1 has a heel section 5 and a toe section 6 and wherein the skate comprises a skate iron/blade 2. In one embodiment the skate iron/blade 2 is secured to the shoe/boot section 1 by mounting parts 3,4, wherein one mounting part 3 is located between the skate iron/blade 2 and the heel of the shoe/boot section 1, whereas the second mounting part 4 is located between the skate iron/blade 2 and the toe section 6 of the shoe/boot part 1. Between the skate iron/blade 2 and the toe section 6 of the skate is located a resilient body/spring 7 that through compression may store/magazine energy, wherein said energy may be liberated when the power compressing the resilient body/spring 7 is reduced or removed for thereby transferring this energy to the shoe/boot part 1 to strengthen/enhance the manoeuvre being executed by the performer wearing the skate. The device according to the invention additionally includes a hinge or a sliding section 8 in the mounting part 3 and/or inside the heel 5 about which the skate iron/blade 2 or the mounting parts 3 may pivot about or move inside.

In the depicted embodiment in FIG. 1 at least one of the mounting sections 3,4 is constructed to be compressed in the vertical direction. Such compressing may be obtained in different ways. In one embodiment one or both of the mounting parts 3,4 may comprise vertically telescoping parts wherein each end of the resilient body 7 is mounted to separate ends of the telescoping sections so that the resilient body 7 may be compressed, preferably vertically, by compressing the telescoping parts inside the mounting device(s) 3,4. The resilient body 7 works between the shoe/boot part 1 and the intermediate section 4 to avoid the skate iron/blade 2 changing its position in relation to its location in the skate.

Figure 2:
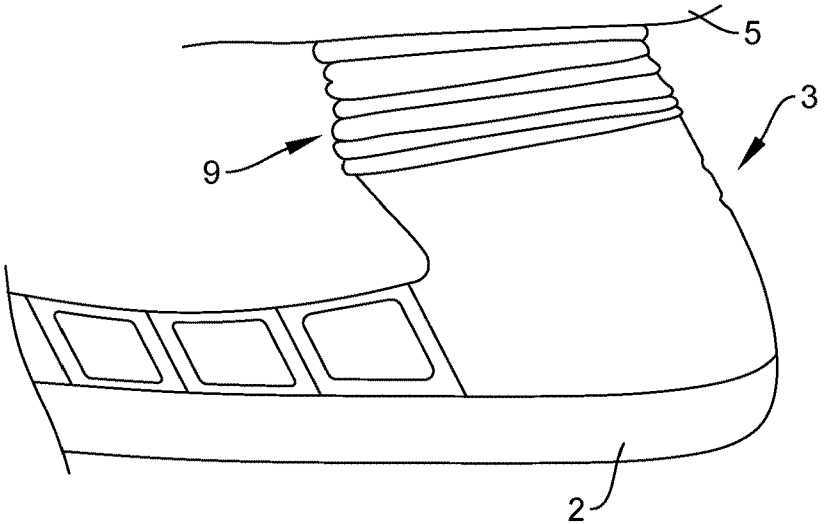
FIG. 2 shows an embodiment of a mounting section between a skating iron/blade and a skating shoe/boot.

To avoid ice and snow entering the telescoping parts or the hinge or the sliding parts 8, one or both of the intermediate sections 3,4 may be equipped with an "accordion" 9 being mounted between the shoe/boot part 1 and each of the intermediate parts 3,4 (see FIG. 2). In one embodiment the parts that are moveable and that do not comprise the entire or parts of the resilient body 7, may be made of a pliant material such as sponge or foam. Such materials may be present out of aesthetic considerations and/or as materials that may prevent snow, ice and moisture from entering into the inner parts of the skate. In an alternative embodiment the entire or parts of the piece between the forward 4 and rear 3 intermediate sections may include such a material.

Since skates for team sports such as ice hockey or bandy, or figure skating/ice dancing being conducted on ice or a non-ice-covered surface (e.g. indoor bandy or indoor hockey performed on roller-skates and/or in-line skates on asphalt, concrete or an artificial surface) have to be manoeuvrable, the skate iron/blade part 2 or the corresponding part of roller skates or in-line skates carrying wheels, is mainly of the same length as the shoe/boot part 1. Such a construction will make it possible to perform rapid manoeuvres such as directional changes, overlays, swerves, pirouettes, landings after a jump and stops during a play or performance. After such manoeuvres it is of significance that a performer is able to accelerate rapidly, and for this purpose the device according to the present invention represents an improvement. On account of such manoeuvres both the skate iron/blade section 2 and the shoe/boot section 1 of the skate will be subjected to forces attacking from all sides. It is consequently of importance that the skate is stable in all directions and that the resilient parts/springs 7 mainly do not react to cross-acting forces and are mainly movable in a vertical upward and downward direction in relation to the shoe/boot part 1 and the skate iron/blade part 2.

Even if the skate iron/blade part 2 is movable in an up- and downward direction in relation to the intermediate mounting sections 3,4 or the shoe/boot section 1, the stability of the skate will be inappropriate if the skate iron/blade 2 is carried in a liquid fashion in the mounting sections 3,4. It is consequently preferred that a skate according to the present invention carries a hinge 8 in the rear mounting section 3 and a resilient part 7 magazining energy internally and that optionally is supported by or is mounted to the forward mounting element 4.

Figure 3:
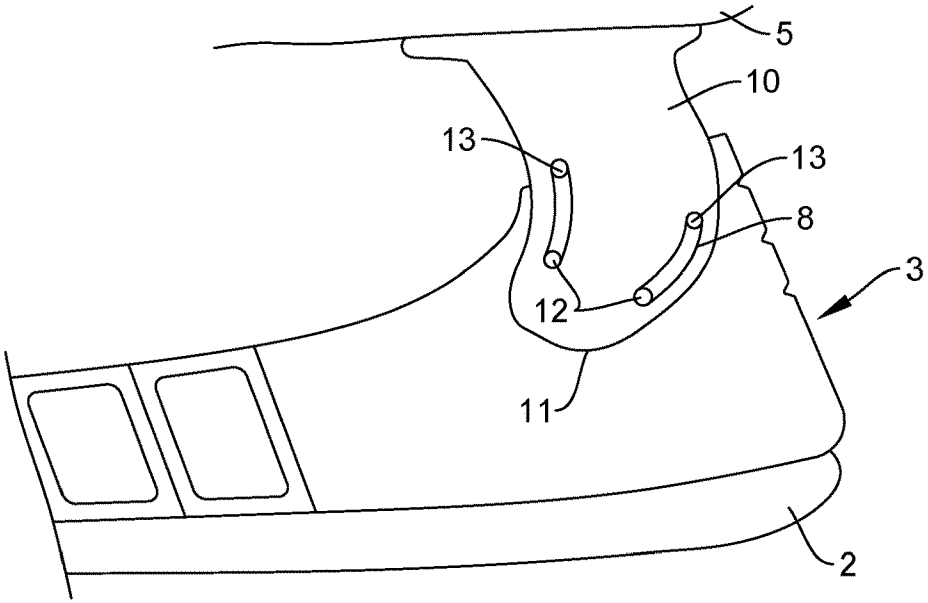
FIG. 3 shows an embodiment of the internal assembly of a sliding device that may be placed inside a mounting section between a skate iron/blade and a skate shoe/boot.

In an alternative embodiment the stability of the skate according to the invention may be ensured even if the rear mounting element 3 is movable for exploiting the magazining of energy of the spring 7 optimally. In such an embodiment the upper part of the rear mounting element 3, i.e. the part of the rear mounting element 3 being located closest to the heel 5 of the shoe/boot part 1, may be equipped with a column 10 running in a groove 11 in the mounting part 3 or vice versa. The column 10 is in this embodiment equipped with crossing grooves or tracks 12, said grooves or tracks carrying cross-pegs 13 being secured to the mounting section 3. Such a construction will make the rear mounting section stable sideways, while it may move mainly vertically up and down. The grooves or tracks may be straight or curved (see FIG. 3).

Such a construction of a skate as disclosed supra is best suited for skates used in team sports (ice hockey, bandy, indoor hockey) or in figure skating or ice dancing wherein the manoeuvrability is of importance more than in distance skating that do not to the same extent need to be manoeuvrable.

Another consideration of importance concerning the construction and assembly of skates according to the invention is the stability of the skate. Even if performing to skate with skates of variable stability may be learned, it is preferable that the skate according to the invention comprises one or more resilient devices 7 in the forward section 4 of the skate and a horizontal pivot axis/hinge 8 in the rear part 3 of the carrying elements 3,4 being located between the skate iron/blade 2 and the shoe/boot part 1 of the skate and being hinged so that the pivot axis of the hinge runs perpendicularly to the length axis of the skate.

However, if the carrying parts 3,4 comprise telescoping parts providing sufficient stability, in an alternate embodiment there may be located one or more resilient elements 7' in the rear section of the rear carrying part 3 of the skate.

In an alternative embodiment as shown in FIG. 6, the resilient device 7 is formed by a plate suspension/spring being secured to the skate iron/blade 2 at the middle section of the skate, and runs tilted upwards towards the forward part of the skate. In this embodiment a shoe/boot part (not shown) may be secured to the spring 7 in the forward section and to the hinge 8 in the rear section of the skate. In this embodiment the rear mounting part 3 is made of a stiff material carrying the shoe/boot part, whereas the forward mounting part 4 either is not present or is made of a non-carrying and compressible material so that the effect of the spring 7 may be fully exploited. Alternatively, the forward mounting section 4 may be made of an elastic material for assisting the resilience of the spring 7. The width of the spring 7 will run across mainly the total width of the shoe/boot part of the skate for optimizing the torque stability and sideways stability of the skate. The spring 7 may in one embodiment be cast together with the skate iron/blade part 2 or may alternatively be secured to the skate iron/blade part 2 through securing devices such as screws or rivets.

The tension of the spring(s) 7,7' may be adjusted to fit the weight of the performer. Since skates normally are adjusted to the size of the performer (child's skates, youth skates, adult skates, gentlemen's skates, skates for females, etc.) the tension of the resilient parts 7,7' will be pre-adjusted to the weight of the performer. Consequently there may exist resilient parts 7 and optionally 7' (if present) be adjusted to weight classes, e.g. 30-50 kg, 50-70 kg, 70-90 kg, 90-110 kg, etc.

Since the size of the shoe/boot section 1 of the skate is not necessarily always proportional to the weight of a performer (a person with large feet may weigh little and vice versa), one embodiment of a pair of skates according to the present invention will be comprised of a set wherein the skate iron/blade section 2 and the shoe/boot section 1 are present as separate parts. Alternatively a skate section and a shoe/boot section may be formed as a unit. It may e.g. be cast in carbon composite wherein the resilient system (securing device) is cast in between the skate section and the shoe/boot section. The skate iron/blade part 2 and the shoe/boot part will in this embodiment comprise locking and releasing devices so that the shoe/boot section 1 may be equipped with alternative skate iron/blade parts 2 for adapting the tension of the spring(s) 7,7' to the weight and the foot size of the user. Such an alternative may be an option, but need not be an absolute solution. The spring system may also be envisaged to be constructed by completely different materials than typical traditional materials for resilience, such as e.g. plastic, carbon, etc. Weight will be one of the major factors in the development of a skate, a shoe/boot section and a skate iron/blade. In one embodiment the device according to the invention will exist as a set of exchangeable parts separately comprising a shoe/boot part 1 and a skate iron/blade part 2 per skate.

Securing devices between the skate iron/blade part 2 and the shoe/boot section 1 may be of a conventional type such as screw, snap or rivet devices or they may also be cast into the skate part and the shoe/boot part.

For adjusting the resilient device(s) 7,7' the skate iron/blade part 2 may be secured to the carrying intermediate sections 3,4 by a separation line/separation plane 14 dividing the skate iron/blade part 2 from the carrying sections 3,4. Such an alternative will make it possible to gain access to one or both of the springs 7,7' and/or the hinge 8 by separating the skate iron/blade part 2 at the separation line 14. This makes it possible to maintain the skate according to the invention as well by e.g. exchanging any of the spring part(s) 7,7' separately if one or both e.g. have started to rust or the tension of spring(s) needs to be adjusted through oiling or surveying the wear of the hinge 8.

An alternative locking system may be located between the mounting parts 3,4 and the shoe/boot part 1 of the skate according to the invention, as shown in FIG. 4*a*, FIG. 4*b* and FIG. 5. The locking/securing system between the shoe/boot part 1 and the intermediate mounting parts 3,4 is shown as a mechanical locking system comprising a handle 15 being secured to the mounting part 3,4 via a hinge 16. The handle runs by an arm through the hinge 16. The handle 15 runs by an arm 16 through the hinge 16 to a rail 18 running/sliding horizontally in the mounting part 3,4 and is connected to hooks extending up and above the separation plane 14 between the relevant mounting part 3,4 and the toe 5 and/or heel 6 section. In such an embodiment the relevant section of the shoe/boot part 1 will be equipped with a corresponding number of slits 20 as the hooks 19 in the mounting parts 3,4 so that the hooks 19 may penetrate into the slits 20 when the hooks are placed in their extending position. Through the slits 20 there run pins or rods 21 across the direction of the slots that the hooks may connect to. By activating the handle 15 the hooks 19 may thus be elevated inside the slots 20 to engage the rods 21 for securing the shoe/boot part 1 to the mounting part(s) 3,4.

The alternative for the securing system disclosed supra secures the lower part of the skate to be connected to the shoe/boot part 1 without using rivets. The hooks 19 are secured and loosened by using an "arm" or handle 15 preferably lying on each side of the mounting parts 3,4. The hooks are preferably curved in opposite directions on each side of the respective mounting part 3,4 thereby locking in opposite directions of each other for securing the solidity forwards and backwards in the locking system. It is alternatively possible to equip at least one of the mounting parts 3,4 with upright solid plates that are not associated with the securing system 15, 17, 18, 19 but serve the purpose of stabilizing the lock between the mounting parts 3,4 and the shoe/boot part 1. In such an embodiment the securing plate(s) will preferably be located on each side of the securing pin(s)/rod(s) 21.

In a preferred embodiment of the shoe/boot part 1 of a skate or a skate assembly according to the invention, the shoe/boot part 1 is equipped with shoelace openings 22 being rectangular or square and that lie with their longer sides mainly parallel to the contour of the forward part of the shoe/boot part 1 of the skate. Such a construction of the shoelace openings 22 will be better suited to laces with a flat appearance and will lessen the wear between the shoe lace apertures/borders 22 and the lace (not shown).

In the present disclosure it has been referred to the front 4 and rear 3 mounting parts. This phrase does, however, not necessarily refer to separate mounting parts. In one embodiment the entire area between the shoe/boot part 1 of the skate and the skate iron/blade 2 may comprise of one piece, wherein in this piece are located securing elements with corresponding functions as the mounting elements 3,4. Such an alternative may be present e.g. in the construction shown in FIG. 6 wherein the carrying elements are the rear mounting part 3 and the forward part is the spring 7 per se. The section between the rear mounting part 3 and the forward part 4 may be open or may comprise completely or partly a pliant material.

Examples of resilient materials comprise metals such as steel, metal alloys, rubber, hard plastic, etc. Examples of pliant materials are e.g. porous synthetic materials such as foamed polyethylene (PE), foamed polyethylene terphthalate (PET), foamed polyurethane (PU) or mixtures thereof.

EMBODIMENT EXAMPLES

Example 1

This example relates to an embodiment of a skate as shown in FIG. 1. The shoe/boot part 1 is adjusted to persons with a European shoe size of 30-50 such as 30, 35, 36, 37, 38, 39, 40, 41, 42, 43, 44, 45, 46, 47, 48, 49 or 50 or half shoe sizes there between. The shoe/boot part 1 has a sole towards the skate iron/blade part 2,11 being made of a rigid artificial material such as hard plastic and the upper part is made of leather. The shoe/boot part is lined with a natural or artificial wool material for the sake of warmth. The shoe/boot part 1 comprises, in this embodiment, a support area running along the ankle and optionally calf of the performer. The skate in this example is adjusted to ice hockey and has a skate iron/blade part 2 of mainly the same length as the shoe/boot part 1. In this connection it will be mentioned that a corresponding construction of the skate but without support for the ankle/calf in the shoe/boot section 1 may be made for bandy or figure skating.

Between the skate iron/blade 2 and the sole of the shoe/boot part 1 there runs beneath the heel section 5 a support column 3 with a width towards the sole of the shoe/boot part 1 corresponding mainly the width of the shoe/boot part 1 and diminishes in width down towards the skate iron/blade part 2, said skate iron/blade part 2 having a skate iron 11 with a breadth of about 0.5 cm. The support column 3 comprises a horizontally acting hinge 8 located between the skate iron/blade 2 and the support column 3 and about which the support column 3 and shoe/boot part may see-saw. The rear support column 3 is made of a rigid material that may carry the weight of the performer, such as of a metal or a metal alloy, e.g. aluminum, or may be made of a rigid plastic material such as PVC or a combination of such materials.

Beneath the toe area 6 of the shoe/boot section 1 there runs a forward support column 4 having the same dimensions as the rear support column 3. The forward support column 4 is made of a compressible material (rubber) and has a cast-in spring 7 of blade steel with a thickness of 0.75 cm, a breadth equal to the breadth of the sole of the shoe/boot part and with an opening between the blade springs corresponding to the height of the forward column section 4. The pre-tension of the spring 7 is in the interval between about 25 kg and 90 kg to be adapted to a performer with a bodyweight within this interval. The working range of the spring 7 lies within the interval 0.5-5 cm.

In this example the skate iron/blade 2 is about 5 mm wide and is preferably hollow-trimmed for optimal manoeuvrability on the ice surface. The forward section of the skate iron/blade 2 is smooth.

Example 2

This example concerns a skate adapted to figure skating. The construction of the spring device in the skate according to this example corresponds to the spring device and the hinge explained in Example 1. The shoe/boot part 1 is in this example limited upwards to support of the ankle and does not include any support for the calf of the performer. The skate iron/blade 11 includes in this example spikes for adapting the skate to figure skating and the spikes serve the purpose of rapidly halting the performer in reverse skating.

Example 3

The construction of the spring section of the skate according to this example is as shown in FIG. 6. The shoe/boot part of the skate according to this example corresponds to the one disclosed in Example 1 or 2.

Example 4

This example relates to an embodiment wherein the shoe/boot section 1 may be removed from the skate iron/blade part 2.

In the disclosure of the present invention it has been used expressions such as "mainly", "about", etc. For the sake of clarity it will be mentioned that such expressions are meant to include an uncertainty interval of ±10% of the relevant measurement number. If e.g. a size of "about" 10 cm is specified, the variation interval will be ±1 cm, i.e. will vary from 9 cm to 11 cm.

The invention claimed is:

1. A skate comprising:

a shoe/boot part;

a skate iron/blade part; and an intermediate section between the shoe/boot part and the skate iron/blade part, the intermediate section including a forward mounting element and a rear mounting element, wherein the forward mounting element includes a compressible/resilient element configured to be compressed in a vertical direction when a force acts on the skate, the force having a vertical component to be assimilated by the compressible/resilient element and to be released when the force on the skate diminishes for assisting skating movements performed by a user of the skate, wherein the rear mounting element includes a horizontally working hinge, the rear mounting element being devoid of a compressible/resilient element.

2. The skate according to claim 1, wherein at least one of the forward or rear mounting elements comprises telescoping parts.

3. The skate according to claim 1, wherein at least one of the forward or rear mounting elements is sheathed by a pliable material.

4. The skate according to claim 1, wherein the intermediate part is configured to be disassembled from the shoe/boot part.

5. The skate according to claim 1, wherein the compressible/resilient element is configured to be compressed at loads within a range from 30 kg to 110 kg.

6. The skate according to claim 1, further comprising a securing system disposed between the shoe/boot part and the intermediate part, the securing system including a handle that via an intermediate rod effects extending hooks fitting into a plurality of slots defined in the shoe/boot part, the plurality of slots having disposed therein cross-running rods that the hooks are configured to attach to.

7. The skate according to claim 6, wherein the hooks on each side of the intermediate part are curved opposite from each other.

8. The skate according to claim 6, wherein at least one of the forward or rear mounting elements is equipped with at least one plate section configured to extend into a respective slot and secure the shoe/boot part from horizontal movement against the forward and rear mounting elements.

9. The skate according to claim 1, wherein the shoe/boot part is equipped with rectangular shoe lace openings.

10. The skate according to claim 1, wherein the skate is selected from the group consisting of an ice hockey skate, a bandy skate, and a figure skating skate.

11. The skate according to claim 1, wherein the horizontally working hinge includes:

a column having a top end coupled to a heal heel of the shoe/boot part, and a bottom end coupled to the rear mounting element, the column defining at least one groove therein; and at least one peg fixed to the rear mounting element and configured to slide within the at least one groove as the rear mounting element moves vertically relative to the heel of the shoe/boot part.

12. The skate according to claim 1, wherein the compressible/resilient element extends perpendicularly to a longitudinal axis defined by the shoe/boot part.

13. The skate according to claim 1, wherein the horizontally working hinge is directly coupled between the shoe/boot part and the rear mounting element.

14. A skate comprising:

a shoe/boot part;

a skate iron/blade part; and an intermediate section between the shoe/boot part and the skate iron/blade part, the intermediate section including a forward mounting element and a rear mounting element, wherein the forward mounting element includes a compressible/resilient element configured to be compressed in a vertical direction when a force acts on the skate, the force having a vertical component to be assimilated by the compressible/resilient element and to be released when the force on the skate diminishes for assisting skating movements performed by a user of the skate, wherein the rear mounting element includes a horizontally working hinge, the horizontally working hinge being directly coupled between the shoe/boot part and the rear mounting element.

15. The skate according to claim 14, wherein the compressible/resilient element extends perpendicularly to a longitudinal axis defined by the shoe/boot part.

16. The skate according to claim 14, wherein at least one of the forward or rear mounting elements comprises telescoping parts.

17. The skate according to claim 14, wherein at least one of the forward or rear mounting elements is sheathed by a pliable material.

18. The skate according to claim 14, wherein the intermediate part is configured to be disassembled from the shoe/boot part.

19. The skate according to claim 14, wherein the compressible/resilient element is configured to be compressed at loads within a range from 30 kg to 110 kg.

20. The skate according to claim 14, further comprising a securing system disposed between the shoe/boot part and the intermediate part, the securing system including a handle that via an intermediate rod effects extending hooks fitting into a plurality of slots defined in the shoe/boot part, the plurality of slots having disposed therein cross-running rods that the hooks are configured to attach to, wherein the hooks on each side of the intermediate part are curved opposite from each other.

* * * * *